US012674610B2

(12) United States Patent
Bagg

(10) Patent No.: US 12,674,610 B2
(45) Date of Patent: Jul. 7, 2026

(54) QUIET ICEMAKER AND DISPENSER

(71) Applicant: Charles G Bagg, Leominster, MA (US)

(72) Inventor: Charles G Bagg, Leominster, MA (US)

( * ) Notice: Subject to any disclaimer, the term of this patent is extended or adjusted under 35 U.S.C. 154(b) by 0 days.

(21) Appl. No.: 17/664,599

(22) Filed: May 23, 2022

(65) Prior Publication Data

US 2023/0375243 A1 Nov. 23, 2023

(51) Int. Cl.
*F25C 1/10* (2006.01)
*F25C 5/20* (2018.01)

(52) U.S. Cl.
CPC ..... *F25C 1/10* (2013.01); *F25C 5/22* (2018.01); *F25C 2305/022* (2013.01); *F25C 2400/10* (2013.01)

(58) Field of Classification Search
CPC ..... F25C 1/10; F25C 5/22; F25C 2305/022; F25C 2400/10; F25C 1/246; F25C 2400/06
See application file for complete search history.

(56) References Cited

U.S. PATENT DOCUMENTS

2001/0027654 A1* 10/2001 Shapiro ..... F25C 1/125 62/1

* cited by examiner

*Primary Examiner* — Elizabeth J Martin
(74) *Attorney, Agent, or Firm* — Chuck-full of Ideas; Charles G Bagg

(57) ABSTRACT

An icemaker of the type that dispenses ice through an opening in the front of a domestic refrigerator-freezer produces precisely formed crystal clear ice cubes and gently dispenses them one-at-a-time at a totally predictable rate. The ice cubes are formed in separate molds where they cannot touch each other or get stuck together. As each cube is pushed out of its mold, it slides directly into the dispensing chute. Thus, the ice cubes do not rattle around in a noisy plastic bin and there is no need for a whirling rotary hammer to smash the ice apart. As the ice gradually freezes, a miniature conveyor system moves the molds from where they get filled with water to where they get dispensed as ice. During operation, the system is barely audible.

5 Claims, 6 Drawing Sheets

QUIET ICEMAKER AND DISPENSER

BACKGROUND OF THE INVENTION

A conventional icemaker and dispenser of the type that dispenses ice through an opening in the front of a home refrigerator-freezer is an extremely noisy, unreliable, and annoying device. It typically makes a batch of ice chunks by flowing water into a multi-cavity mold and then it noisily dumps them into a bin. If the mold is slightly overfilled as often happens, the chunks will be frozen together into a clump. As a result of temperature variations due to door openings or automatic defrost cycles, while sitting in the bin, the ice may further conglomerate into a large mass which must be broken apart before being dispensed.

A motorized auger is typically used to pull the ice forward where a whirling rotary hammer noisily smashes the ice apart into dispensable-sized pieces and propels them out a chute at disturbingly high velocity with enough force to smash delicate glassware. When a user inserts a container into the dispenser, the number, shape, and size of ice pieces coming out the chute at any given time is totally unpredictable, so the ice may overfill the container, or it may cause an ice jam and clog the chute. If that happens, the dispenser may keep running but no ice comes out of the chute. When the freezer door is opened, a huge pile of ice may fall out onto the floor. In some designs, an ice jam can push back on the dispenser actuator causing the dispenser to not shut off when the container is removed. If it is then switched over from ice to water, water will pour out and not shut off until the jam is cleared.

The entire system may take up well over a cubic foot of space inside the freezer section of the refrigerator. These systems are often unreliable and if some part of the unit fails, it may take considerable skill, tools, and time to repair the unit in place or to remove it and replace it.

BRIEF SUMMARY OF THE INVENTION

The invention disclosed herein employs a completely different method of producing and dispensing ice that eliminates most of the noise and gently dispenses uniform pieces of ice at predictable intervals.

A large array of single cavity molds is carried along a serpentine path by a belt or chain inside a rectangular housing. The molds move whenever a user requests ice by inserting a container into the dispenser. As a frozen mold reaches the front of the system the ice contained therein is quietly ejected from the mold and gently slides down a chute into the container. When the empty mold moves forward it is refilled with water and gradually freezes as it moves along the serpentine path. A user adjustable speed control could determine how rapidly the ice is dispensed.

Since each piece of ice is contained in its own mold until it is dispensed, it cannot get stuck to any other piece. Thus, no noisy auger or rotary hammer is needed.

It should be noted that these are simplified drawings to illustrate the basic concepts.

While they depict a proposed arrangement of the claimed elements, engineering and testing may lead to a somewhat different embodiment to improve performance, manufacturability, cost, etc.

DETAILED DESCRIPTION

Figure 1:
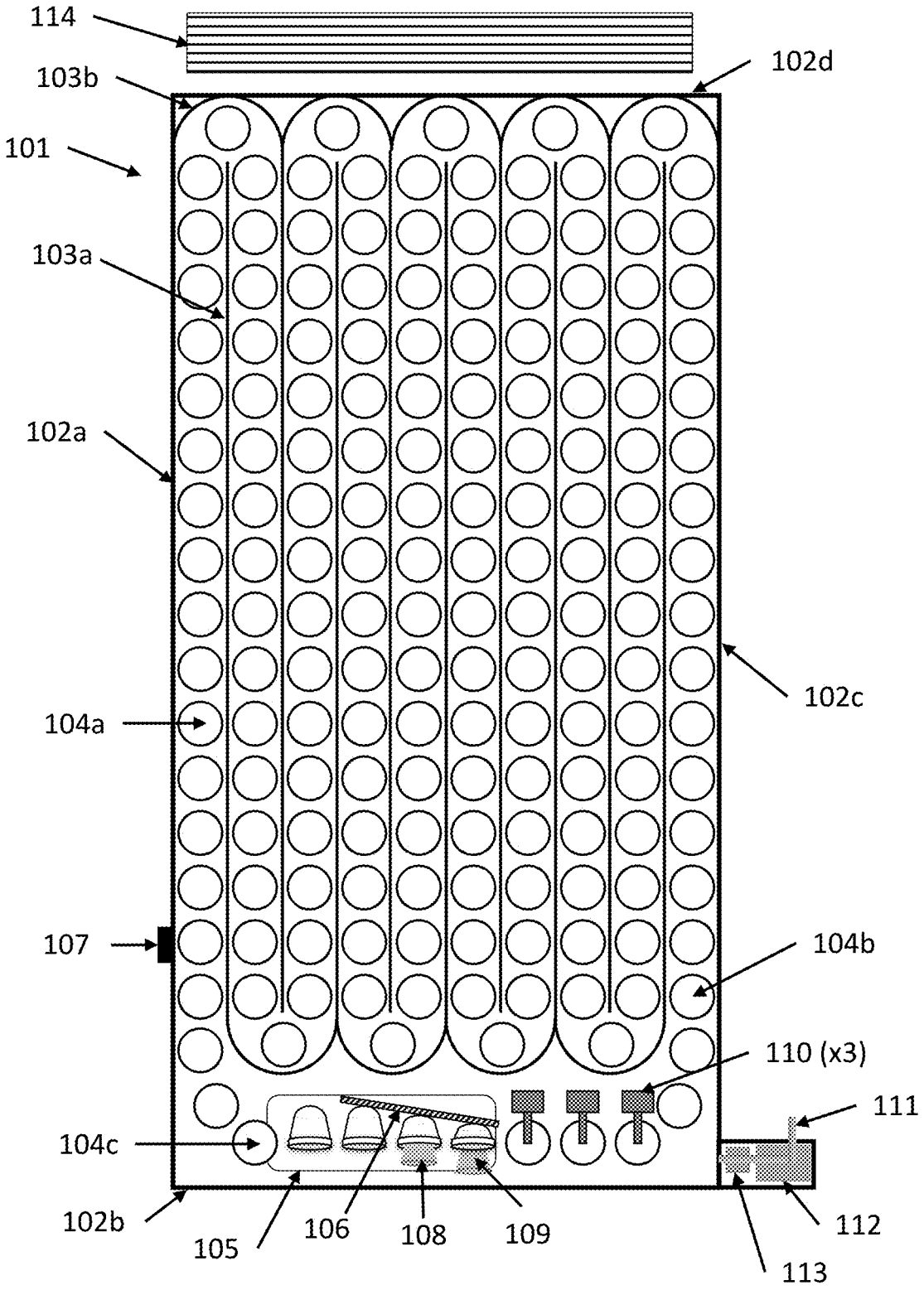
FIG. 1 is a top view diagram showing how the molds are arranged in a serpentine array in a proposed embodiment.

FIG. 1 is a top view diagram of one proposed embodiment with an array of 181 ice molds lined up in a serpentine path within a horizontal rectangular housing about 10" by 20". Item 102*a* is the left side, 102*b* is the front, 102*c* is the right side, and 102*d* is the back. The ice molds move forward along the left side, travel from left to right across the front, where the ice is ejected, and the molds are refilled with water and move backward along the right side. They then move forward and backward in alternate rows till they reach the left side. 103*a* shows one of several straight vertical guide walls to keep the molds lined up and to keep alternate rows separated. 103*b* shows one of several curved vertical guide walls to help the molds navigate the turns at each end of the serpentine path. These guide walls may not be necessary. If present, they may be slotted or perforated to facilitate air flow between the molds. A fan or blower 114 may be used to direct cold air at the molds to speed up the freezing process. These guide walls may be formed as part of the horizontal plate, part of the bottom cover, or as independent parts fitted between the plate and bottom cover.

A typical mold 104*a* on the left side would be fully frozen, while a mold on the right 104*b* would be freshly refilled with water and might not be frozen. If a large amount of ice is used in a short time, all the fully frozen ice could all get used up, and unfrozen or partially frozen molds could reach the ejection area. A fully frozen mold will be cooled close to zero degrees, but any mold that still contains liquid water will be close to 32 degrees. A temperature sensor 107 along the left side near the front would measure the temperature of each mold as it moves forward and would send a signal to the control system FIG. 7 to prevent an unfrozen mold from reaching the front and causing a spill. When a frozen mold 104*c* reaches the front, a specially formed guide wall under the mold 105 tilts the mold sideways. Another specially formed guide wall 106 gently pushes forward on the bottom of the tilted molds to push the ice 108, 109 out of the mold and into a discharge chute mounted in the freezer door.

Instead of a passive guide wall to eject the ice, it may be preferable or even necessary to use active means such as a cam or lever to push the ice out more forcefully. A cam or lever could be driven by the transport mechanism to keep it synchronized with the motion of the molds.

It may be possible to simplify the process somewhat by not tilting the molds. In the simplified embodiment the molds stay vertical, and the bottom of the mold is pushed upward ejecting the ice out the top. A guide above the mold causes the ice to tip forward and fall into the discharge chute. However, that method may require too much additional height.

After ice is ejected from a mold 109, the mold drops back to its vertical orientation to be refilled. If only a single mold is being refilled, there is plenty of time to do it. However, if multiple molds are being emptied and refilled in quick succession while the transport mechanism may be running continuously, fill time is severely limited, and needs to be precisely timed to avoid dispensing water between the moving molds. Yet, if the mold is filled too fast, water might splash out. Thus, it may be necessary to have multiple valves and fill nozzles whereby each one fills a mold part way full as it goes by. Three fill valves and nozzles 110 are shown but more or fewer may be needed.

Depending on the size of the refrigerator-freezer, the size and shape of the icemaker and the number of molds contained therein may be different.

Figure 2:
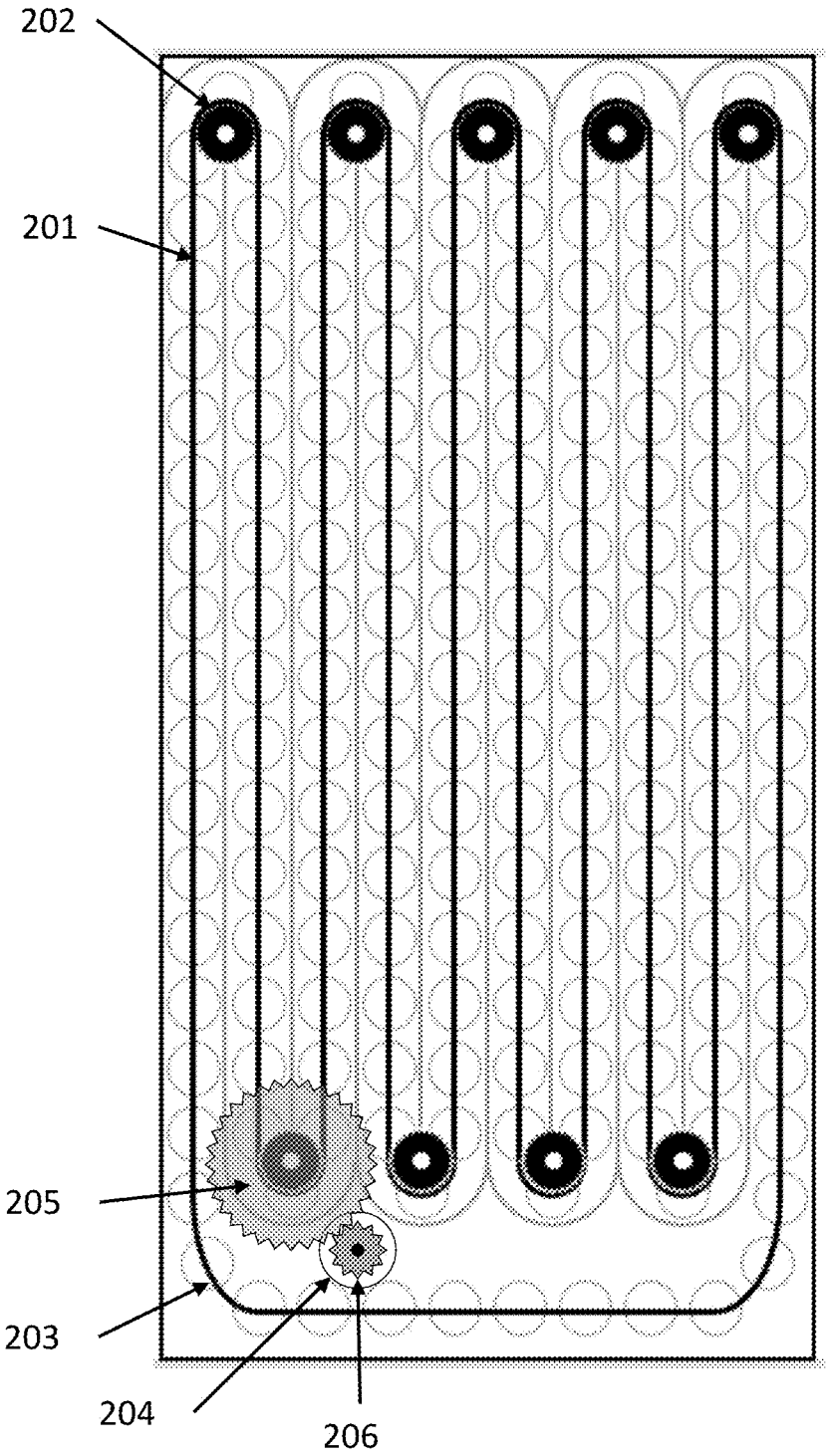
FIG. 2 is a top view of a transport mechanism used to carry the ice along a serpentine path.

FIG. 2 shows the arrangement of the transport mechanism that moves the ice molds along their path. The transport mechanism may use a timing belt or a timing chain 201 wrapped around several supporting rotatable wheels 202, which would be pulleys for use with a belt, or sprockets for use with a chain. The ice molds are suspended from the belt or chain by hangers which may include means to allow the molds to be tilted sideways for dispensing the ice.

Both sides of the belt or chain must alternately engage the pulleys or sprockets as it winds back and forth around them, so the hangers must be attached in a way that does not interfere. The spacing between the hangers should be an exact multiple of space between the teeth of the pulleys or sprockets. The belt or chain is moved along its path by a small motor 204, which is mechanically coupled to rotate one of the supporting wheels as shown by drive gears 205 and 206, though alternate means of mechanical coupling may be used. The motor starts and stops gently to avoid spilling water from the molds. The motor would most likely be mounted to the horizontal plate.

Figure 3:
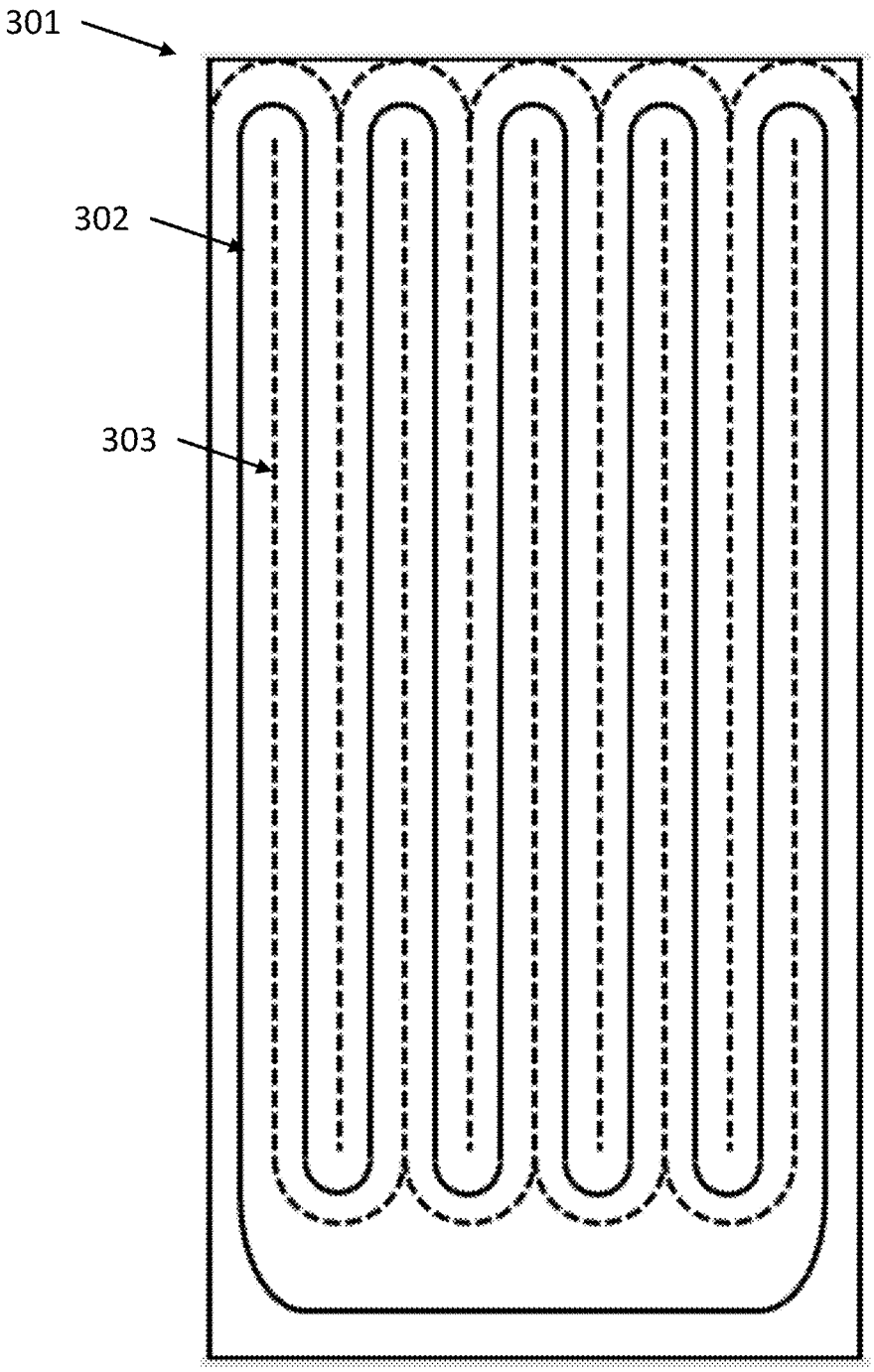
FIG. 3 is a top view of a horizontal plate that supports the transport mechanism. It shows the serpentine slot which follows the same path as the transport mechanism. It also shows with dashed lines the location of a set of vertical guide walls below the plate that keeps the ice molds aligned and provides support for the horizontal plate.

The transport mechanism is mounted to the upper surface of a rectangular horizontal plate (See FIG. 3). A serpentine slot runs through the plate directly below the transport to provide a way for the hangers to extend down below the plate and connect to the ice molds and move them along under the transport. The continuous slot separates the plate into two pieces, and greatly weakens them both. A top cover (See FIG. 6) is attached to the plate, bridging across the slot in multiple locations to strengthen the plate and to join the two parts together. The top cover also protects the transport mechanism from interference or contamination and provides operator safety. The curves near the front 203 may not be circular, so a fixed guide or a series of small idler wheels may be used to establish the shape of the desired curve. Springs may be employed to maintain suitable tension in the transport.

FIG. 3 shows the position of the serpentine slot 302 formed in the horizontal plate 301. It also shows the positions of the vertical guide walls 303 under the horizontal plate, as indicated by the dashed lines.

Figure 4:
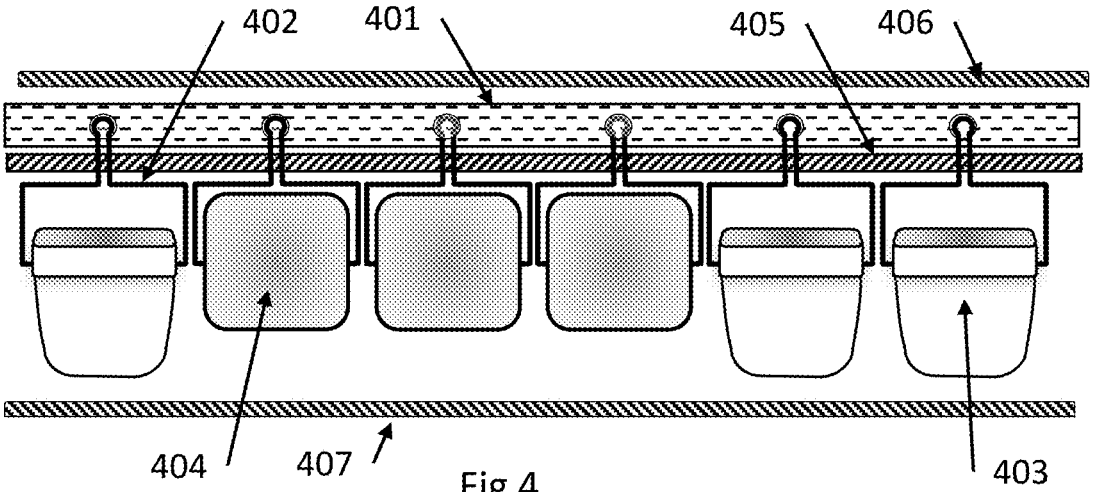
FIG. 4 shows details of 3 squarish ice molds in their normal vertical orientation and 3 more tilted to their horizontal orientation for ejection of their ice.

FIG. 4 shows a group of six squarish ice molds on their hangers 402 suspended from a transport belt or chain 401. Three of the molds are shown in their vertical orientation 403 and the other three are shown tilted to their horizontal orientation 404 for ice ejection. An edge view of the horizontal plate 405 is shown below the transport belt or chain. The top cover 406 is shown above the belt or chain, and the bottom cover 407 is shown below the ice molds.

Since 10 rows of molds are shown in a 10-inch-wide array, each mold would be slightly less than an inch square. The molds are depicted to be about as deep as they are wide, but they may be made deeper than shown to hold more water without it splashing out when the molds are moved by the transport. It is a goal to keep the total height of the icemaker to be not more than three inches, which is less than half the height of a conventional icemaker.

Figure 5:
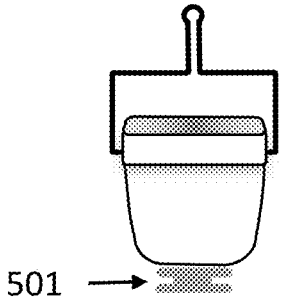
FIG. 5 shows an ice mold with a slotted disk attached to its bottom which might be necessary.

The individual ice molds would be formed from a durable material that remains flexible at cold temperatures such as silicone rubber, with a more rigid collar at the top where it attaches to the hanger. For simplicity, in most of the drawings the shape of each mold is shown as a plain cylinder. In practice, the molds would have to be wider at the top to facilitate ejection of the ice and will likely be made more squarish which would increase the packing density by about 20%. Because the sidewalls of the molds are tapered, ice is easily ejected from the mold by pushing up on the flexible bottom. For dispensing, the bottom of the mold may be tilted backward to a horizontal orientation so that the ejected ice is directed forward toward the front door of the freezer and into a dispensing chute. Ideally, the resilient mold material would spring back on its own to its original shape after the ice is ejected. If it fails spring back fully, water might overflow when the mold is refilled. To make sure this does not happen, a steel spring could be incorporated into each mold, or other means could be employed to force the mold back to its original shape. For example, a disk 501 could be attached to the bottom of each mold and an angled slotted plate could intercept the disk after the ice is ejected and tug on the mold as it moves along to pull it back to its fully extended shape. FIG. 5 shows a grooved disk 501 attached to the bottom of a mold. Since the silicone rubber mold material has a high coefficient of friction it could experience considerable drag rubbing against the guide wall that was trying to eject the ice. The grooved disk could be made of a material with very low friction and could engage a slot in the guide wall with very little drag making it easier to eject the ice. The slotted guide wall could then pull back on the disk to make sure the mold returned to its fully extended shape.

Figure 6:
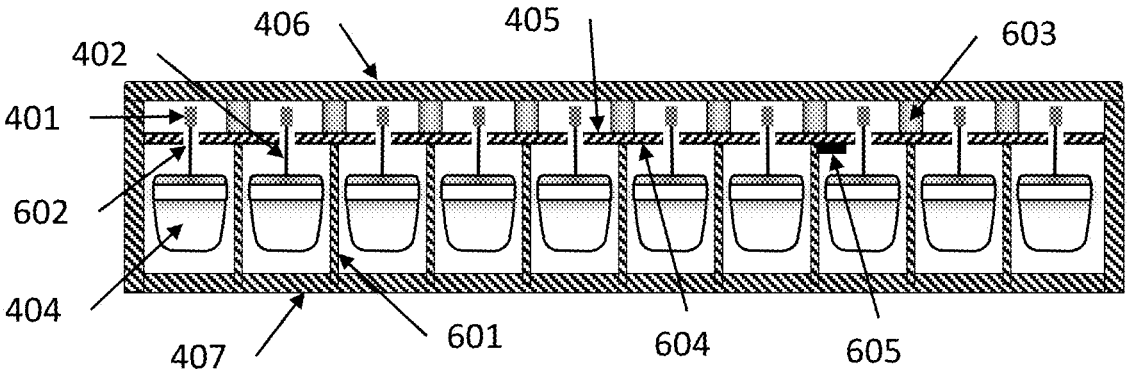
FIG. 6 shows all 10 rows of ice molds with edge views of the top cover, horizontal plate, bottom cover, straight vertical guide walls, and side walls of the rectangular housing

FIG. 6 shows all 10 rows of molds 404 separated by vertical guide walls 601, attached to their hangers 402. The upper portion of the hangers pass through the serpentine slots 602 and are attached to the belt or chain 401. The heated underside of the horizontal plate is indicated by 604. And the second temperature sensor is shown by 605. The top cover and bottom cover are shown by 406 and 407. An array of attachment points are shown by 603 to allow the top cover to bridge across the serpentine slot in multiple locations.

Because water expands by about 9% as it freezes, it would tend to cause the sides of the mold to bulge out, making ejection difficult. Careful design of the mold shape would prevent this problem by allowing the ice to slide upwards in the mold to accommodate the expansion. Another way to prevent side bulge would be to force the bottom to freeze first with the top freezing last. This can be accomplished by having a gentle heater 604 on the underside of the horizontal plate. This would also prevent frost buildup from the liquid water evaporating and condensing on a cold plate. Forcing the molds to freeze from the bottom up may also cause the ice to be clearer due to less entrapped air. Clear ice is considered preferable for cocktails. Carefully directed cold airflow at the bottom of the molds could also help the process.

In operation, it would be possible to get a single ice cube if desired. The transport would start up and move forward the distance of one mold and stop again. As the ice dropped down the chute, the previously emptied mold would get refilled. In this mode, it could dispense about one cube per second. If many cubes are needed quickly, the transport could run continuously, dispensing about two or possibly three cubes per second. Thus, the entire array of 180 cubes (weighing about 5 pounds) could be dispensed in 90 or perhaps 60 seconds.

Because this quiet icemaker is only about three inches high, two of them could be installed one above the other in a freezer and would still take up less space than a single old-style icemaker. It could even be purchased and installed later by the customer.

When the transport is running in continuous mode, the water filling the molds must turn on and off rapidly to avoid spilling water between the molds. With a single filling spout, each mold may only be in position for less than a half or even a third of a second, which may not be enough time for a complete fill. Thus, multiple filling spouts may be needed with each one doing a partial fill. While it might be possible to use mechanical valves driven by the transport mechanism, solenoid valves under microprocessor control would provide greater flexibility and precision. Some type of non-contact level sensor, perhaps ultrasonic, may be used to provide optimum or even variable fill level.

As with other icemakers built into refrigerator-freezers, a dispenser and operator control panel would be mounted in the freezer door, and the dispenser would also provide water. Crushed ice would be an option, with crushing means mounted within the dispensing chute. A pair of high-torque slow-turning wheels pr tollers would gently crush each ice cube as it passed down the chute, again making a lot less noise than a conventional crusher.

Figure 7:
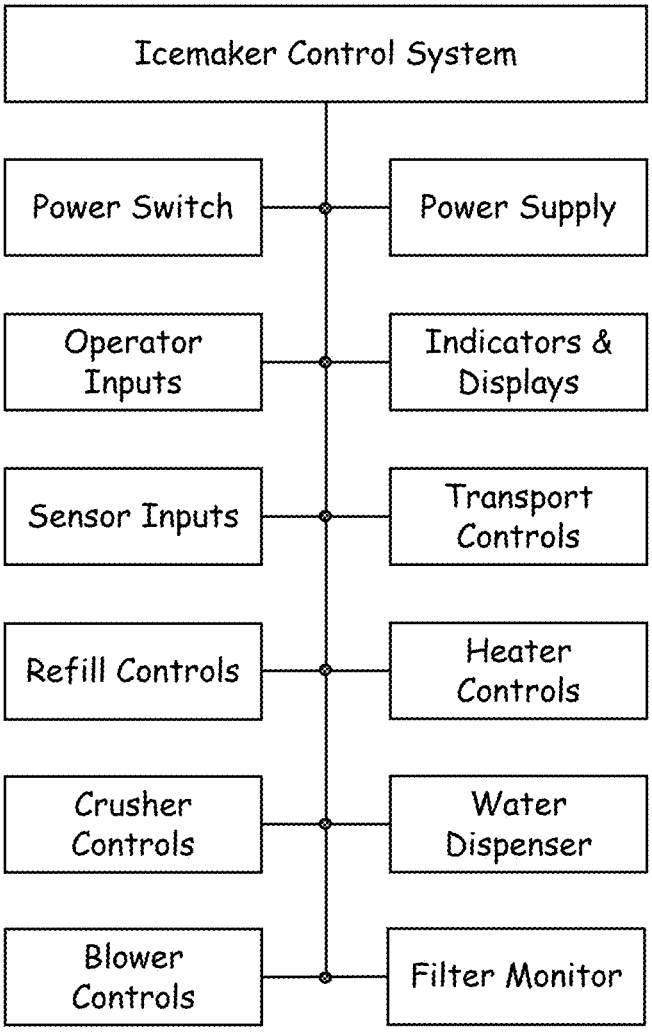
FIG. 7 shows a functional block diagram of the control panel

FIG. 7 is a block diagram of the control panel functionality. The requirements of the control panel are intuitively obvious from the functionality of the icemaker and dispenser and would be designed based on standard engineering practice using readily available parts and materials. Therefore, the various functional blocks do not need to be elucidated in the claims.

Figure 8:
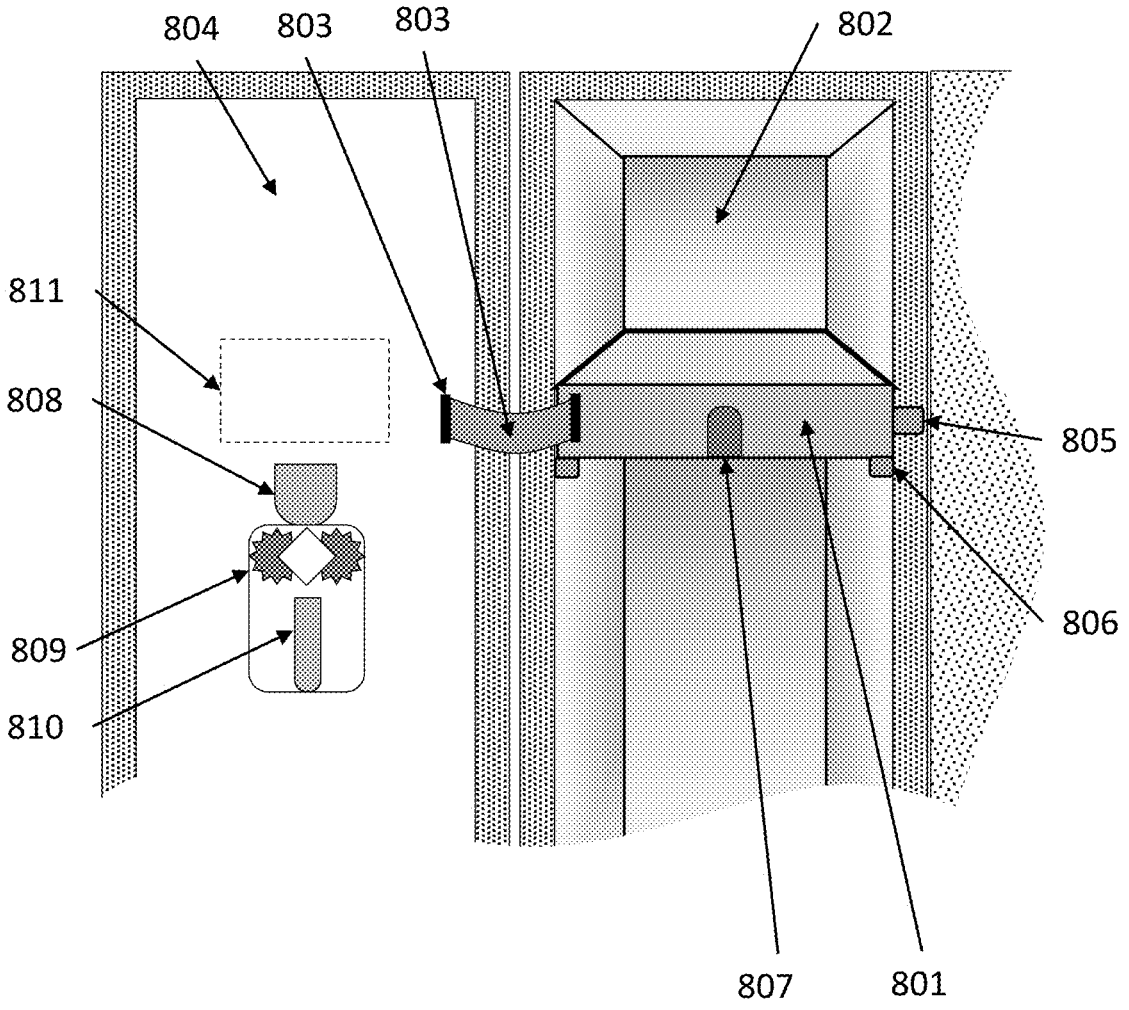
FIG. 8 shows how the silent icemaker and dispenser is mounted in a compatible freezer compartment.

FIG. 8 shows the ice maker enclosure 801 installed in a compatible freezer compartment 802, resting on a pair of support rails 806. (The refrigerator section would be to the right of the freezer in this embodiment.) To simplify wiring, the ice maker would be plugged directly into a mating connector on the freezer door 804 using a flexible ribbon cable 803. This reduces cost and complexity by avoiding the messy labor-intensive process of running the wires through a hollow door hinge. A plumbing fitting 805 would automatically mate with a matching plumbing fitting as the housing was slid into place. The control panel 811 mounted in the door 804 would include the user interface mounted to the outside surface of the freezer door. The discharge chute 809 would line up just below the discharge area 807 of the icemaker when the freezer door is closed. The ice crusher is located in the discharge chute, while in most conventional icemakers, it is part of the rotary hammer mechanism. 810 shows the actuator that detects when a user receptacle is in place. In one possible embodiment, the toothed wheels of the ice crusher could have a sector cut out from each wheel such that when th3 sectors are facing each other, the ice cube could pass through unscathed. When the wheels are rotated partway toward each other an ice cube would get trapped between them and would get crushed as they rotated further together. This avoids needing an extra mechanism to move the axels of the wheels back and forth.

I claim:

1. An ice maker and dispenser for use in a compatible refrigerator-freezer, said ice maker comprising:

a. an array of individual flexible molds to form ice of a controlled shape and size, b. a transport mechanism to move said molds along a continuous horizontal serpentine path, c. an ejection location along said serpentine path where said ice shall be ejected from said molds, d. said serpentine path arranged in several straight rows to fit within a rectangular housing configured to slide into said compatible refrigerator-freezer, e. an array of hangers, each of said hangers having an upper portion attached to said transport mechanism and a lower portion attached to one of said molds, f. a horizontal plate positioned between said transport mechanism and said molds to support said transport mechanism above said molds, g. said plate having a serpentine slot directly below said transport mechanism to allow said hangers to slide along said serpentine slot in unison with said transport mechanism, h. an array of rotatable wheels to support and guide said transport mechanism along said serpentine path, i. an electric motor mechanically coupled to one of said wheels causing it to rotate propelling said transport mechanism along said serpentine path, j. a top cover mounted above said transport mechanism and attached to said horizontal plate in multiple locations to bridge across said serpentine slot and to cover and protect said transport mechanism, k. a bottom cover mounted below said molds to protect them from interference as they move along said serpentine path, l. An array of vertical guide walls extending from said bottom cover to said horizontal plate and located between said rows to keep said molds from interfering with each other as they move along said serpentine path, m. means to eject said ice from one mold at a time as each mold is moved to said ejection location, said means including a first specially formed guide to tip said molds from a vertical orientation to a horizontal orientation and a second specially formed guide to push against said molds to force said ice out of said mold, n. a supply line to deliver potable flowing water to refill each mold after it passes said ejection location, said water having a temperature above freezing o. at least one valve to control the flow of said water, p. a first electric heater thermally coupled to said supply line to prevent said water from freezing therein, q. a first temperature sensor to monitor the temperature of said water, r. said horizontal plate having an electrically heated underside with a temperature above freezing to prevent frost from forming, s. a second temperature sensor to monitor the temperature of said heated underside of said horizontal plate, t. a third temperature sensor to monitor each mold as it approaches said ejection location to determine when the mold is frozen, u. at least one position sensor to monitor each mold as it is being refilled, v. an electrical connector selected to mate with said compatible refrigerator-freezer, w. a plumbing connector selected to mate with said compatible refrigerator-freezer, and x. an electronic control panel capable of responding to user inputs, monitoring all sensors, and controlling all functions of said icemaker and dispenser.

2. The ice maker according to claim 1, wherein said transport mechanism is a timing belt, and said rotatable wheels are toothed timing pullies.

3. The ice maker according to claim 1, wherein said transport mechanism is a timing chain, and said rotatable wheels are sprockets.

4. The ice maker according to claim 1, the dispense comprising a. a discharge chute to catch said ice as it is ejected from a mold in said icemaker and to deposit said ice into a user receptacle, b. a sensor configured to detect the presence of said user receptacle and to send a signal to said control panel to cause said icemaker to dispense ice, c. ice crushing means mounted in said discharge chute and configured to crush said ice as it passes through said discharge chute when directed to do so by said control panel, said ice crushing means comprising a pair of toothed wheels driven by a second electric motor.

5. A method for forming ice cubes in an array of individual molds, comprising filling said molds with water at a first position, moving said molds from said first position to said second position via an indirect path which allows enough time for said water to freeze, and dispensing said ice cubes one at a time at said second position.

* * * * *